United States Patent [19]

Lindsay

[11] 4,450,580

[45] May 22, 1984

[54] ONE-PIECE SHOPPING BAG HANDLES

[75] Inventor: Alexander Lindsay, New York, N.Y.

[73] Assignee: Modern Arts Packaging, Inc., New York, N.Y.

[21] Appl. No.: 357,307

[22] Filed: Mar. 11, 1982

[51] Int. Cl.[3] ..... B65D 33/06

[52] U.S. Cl. ..... 383/6; 383/17; 383/27

[58] Field of Search ..... 229/54 C, 54 R; 383/6, 383/17, 27

[56] References Cited

U.S. PATENT DOCUMENTS

| | | | |
|---|---|---|---|
| 2,980,312 | 4/1961 | Gould | 229/54 C |
| 3,156,206 | 11/1964 | Hall et al. | 229/54 C |
| 3,463,381 | 8/1969 | Wainberg | 229/52 A |

FOREIGN PATENT DOCUMENTS

| | | | |
|---|---|---|---|
| 881944 | 9/1971 | Canada | 229/54 R |
| 1483184 | 6/1967 | France . | |
| 1190262 | 4/1970 | United Kingdom | 229/54 R |

*Primary Examiner*—Stephen P. Garbe
*Attorney, Agent, or Firm*—Stempler & Cobrin

[57] ABSTRACT

A pair of handles for a shopping bag, each handle having a base and a bail molded of one-piece plastic construction, are disclosed. The opposite ends of the bail are integrally connected to the base in a manner so as to impart an aesthetically pleasing, generally flat appearance to the bag in the regions overlying the bail ends. The bail has a twisted hand grip portion having a smooth lower surface free of sharp edges to facilitate carrying the bag.

4 Claims, 5 Drawing Figures

ONE-PIECE SHOPPING BAG HANDLES

BACKGROUND OF THE INVENTION

1. Field of the Invention

The invention relates to handles for a paper shopping bag and, more particularly, to one-piece handles of molded plastic construction.

2. Background of the Prior Art

In a shopping bag of the type having a folded interior hem at the open end of the bag, it is known to provide multi-part handles with each part being constituted of a different material. Each handle comprises a base mounted within the fold between the hem and the side wall of the bag, and an elongated bail having its end portions connected to the base underneath the hem, and an intermediate bight portion extending away from the open end of the bag. In a known prior art embodiment, the bail is made of thick strong cord or rope made of intertwisted strands of fiber; the base is a discrete element made of cardboard or a heavyweight paper; and metal staples are used to connect the ends of the rope bail to the cardboard base.

Although the known multi-part and multi-material handles of the prior art are generally satisfactory for their intended purpose of providing a hand grip for carrying objects in a shopping bag, they have not proven to be altogether reliable in practice. First of all, three different parts each of a different material must be separately ordered, shipped, inventoried and assembled. This is extremely time-and labor-consuming and results in a very expensive overall manufacturing operation. Secondly, the staples sometimes fail to adequately connect the bail ends to the base, and this failure causes the bails to suddenly separate from the bag, thereby resulting in accidental breakage of the objects in the bag. Thirdly, the thick rope of the bail ends and the metal staples which lie over the same constitute non-flat raised connections which are sandwiched between the hem and the side walls of the bag. These non-flat connections impart a lumpy and aesthetically displeasing appearance to those portions of the bag which overlie these non-flat connections. Fourthly, the bight portion which is grasped by the hand of a user sometimes tends to crease, or tends to cut into, the user's hand, particularly when the underside of the bight portion is somewhat rough and has a sharp edge, and particularly when relatively heavy objects are placed in the bag.

SUMMARY OF THE INVENTION

1. Objects of the Invention

Accordingly, it is the general object of the invention to overcome the drawbacks of the prior art shopping bag handles.

Another object of the invention is to provide a one-piece shopping bag handle which eliminates the prior art necessity for ordering, shipping, inventorying and assembling a plurality of arts, each of a different material, for the handle.

Still another object of the invention is to provide a reliable shopping bag handle of one-piece molded plastic construction which is strong enough to resist tearing even when relatively heavy objects are carried in the shopping bag.

Yet another object of the invention is to provide a shopping bag handle which is mounted in an aesthetically pleasing manner on the bag such that the end portions of the bail are connected to the base underneath an interior folded hem of the bag so as not to impart an undesirably raised, lumpy appearance to those bag portions overlying the connections of the bail to the base.

An additional object of the invention is to provide the shopping bag handle with a twisted bail having a smooth lower surface facing the open end of the bag so as to avoid excessive creasing of the hand of a user grasping the twisted bail, particularly when relatively heavy objects are carried in the bag.

A further object of the invention is to provide a pair of light-weight but sturdy handles for carrying a shopping bag, each handle being inexpensive to manufacture, simple in construction, and durable in use.

2. Features of the Invention

In keeping with these objects and others which will become apparent hereinafter, one feature of the invention resides, briefly stated, in a pair of one-piece handles for a shopping bag of the type having an interior folded hem at the open end of the bag. The handles are mounted on opposite sides of the bag to support the same in a balanced manner. Each handle has a substantially planar, relatively thin, elongated base constituted of a moldable plastic material, such as polyethylene, and an elongated bail also preferably constituted of the same material so as to form a one-piece molded plastic construction therewith.

Each base is mountable at the open end of the bag underneath the hem at opposite sides of the bag. Each bail has one end portion integrally and rigidly connected to the base at a predetermined location thereon, preferably located adjacent one end region of a respective base, and an opposite end portion integrally and rigidly connected to the base at another location thereon, preferably located adjacent the opposite end region of the respective base. Each bail end portion lies underneath the hem and has smooth outer surfaces at opposite sides thereof. The thickness of each bail end portion, as measured between the outer surfaces thereof, preferably gradually decreases as considered in the longitudinal direction towards the tips of the bail end portions. Each bail end portion converges to the thickness of the relatively thin base portion. Each smooth outer surface of the bail end portions lies substantially close to the plane of the base so as to impart an aesthetically pleasing, substantially flat appearance to the bag in the regions overlying the bail end portions.

Each bail also includes an intermediate bight portion located between the bail end portions and extending away from the open end of the bag. The bight portion includes a twisted hand-engaging portion which has a smooth lower surface facing the open end of the bag, and being free of sharp edges. This feature facilitates the user's grip on the handle and avoids the aforementioned creasing problem of the prior art.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENT

Figure 1:
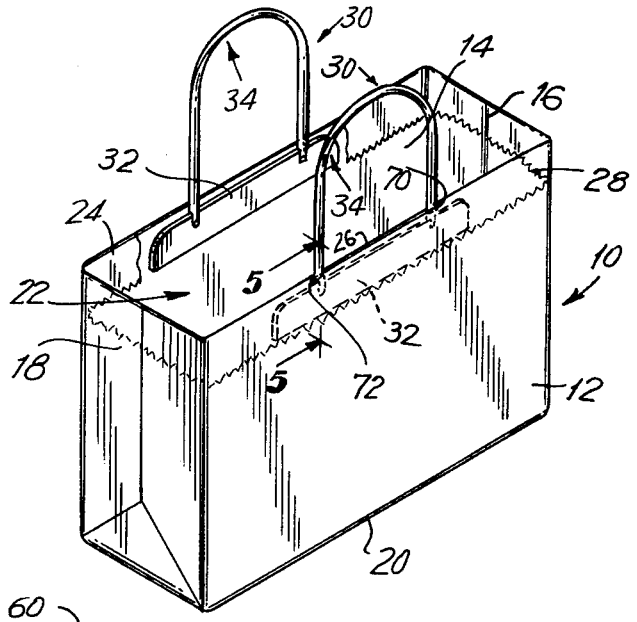
FIG. 1 is a perspective view of a shopping bag equipped with two handles in accordance with this invention, with the hem being broken-away to show one of the handles with greater clarity.

Referring now to FIG. 1 of the drawings, reference numeral 10 generally identifies a shopping bag of the type having a front panel 12, a rear panel 14, a pair of side panels 16, 18, and a bottom 20. Each side panel preferably has a vertical crease to permit the front and rear panels to be moved toward and away from each other, to thereby respectively close and open the bag 10. The bag 10 has an open upper end 22 located opposite to the bottom 20, which constitutes the closed end of the bag. The bag 10 also has an inner hem 24 which is conventionally formed by folding the upper marginal portions 28 of the panels 12, 14, 16, 18 inwardly into the interior of the bag, and pressing the hem 24 to lie substantially flat against the upper panel portions which bound the open end 22 of the bag. A slit 26 is formed longitudinally for a predetermined distance along the fold line formed by the hem 24 with the upper marginal portion of the front panel 12 in the upper central region of the same. Another non-illustrated slit is formed for a predetermined distance along the fold line formed by the hem 24 with the upper marginal portion of the rear panel 14 in the upper central region of the same.

Figure 2:
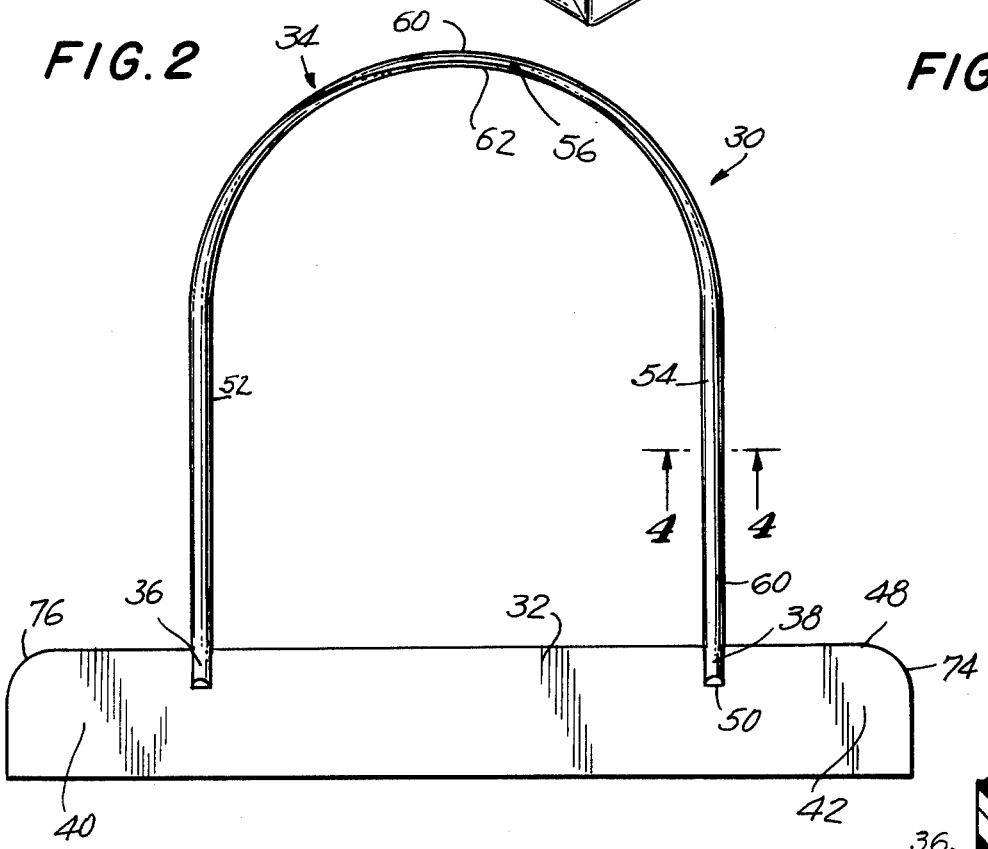
FIG. 2 is a front view of one of the handles of FIG. 1.
Figure 3:
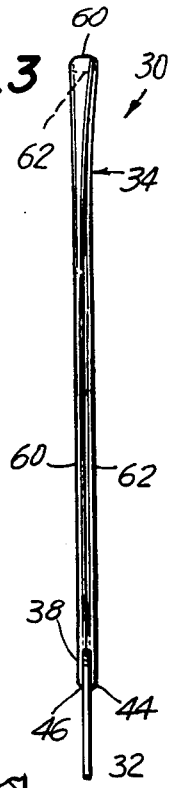
FIG. 3 is a side view of the handle of FIG. 2.

In accordance with this invention, a pair of one-piece handles 30 are respectively mounted at the slits on the front and rear panels. As best shown in FIGS. 2 and 3, each handle 30 has a substantially planar, elongated, relatively thin (on the order of 1/16 inch) base 32 constituted of a moldable plastic material such as polyethylene, and an elongated bail 34 also constituted of a moldable plastic material, and preferably being injection molded with the base 32 to form a one-piece construction therewith.

Each bail has one end portion 36 integrally and rigidly connected to the base 32 at a predetermined location thereon, preferably at end region 40 of the base. The opposite end portion 38 of each bail is integrally and rigidly connected to the base 32 at another location thereon, preferably spaced longitudinally away from the end region 40 at the opposite end region 42 of the base. Each bail end portion extends transversely along the base for a minimum distance (on the order of ⅛ inch) and has a tapered configuration. As best seen in FIG. 3, representative bail end portion 38, just like bail end portion 36, has a pair of opposite smooth outer surfaces 44, 46 which continuously converge towards each other as considered in the downward direction towards the base. The thickness of representative bail end portion 38, as measured between the outer surfaces 44, 46, varies from a maximum of about 3/32 inch at the upper edge 48 of the base to a minimum of about 1/16 inch at the tip 50. At the tip 50, the thickness of representative bail end portion 38 corresponds to the thickness of the base 32. As discussed in further detail below, the outer surfaces 44, 46 lie in close relationship to the plane of the base 32.

Each bail 30 also has an intermediate bight portion located between the bail end portions 36, 38. The intermediate bight portion includes a pair of arms 52, 54 respectively connected at their lower ends to the bail end portions 36, 38, and a twisted hand-engaging or grip portion 56 at the upper ends of the arms to complete the loop of the intermediate bight portion. The intermediate bight portion has a cross-section which is constant along its length. In a preferred embodiment, this cross-section has a generally flattened oval shape, as shown in FIG. 4.

Figure 4:
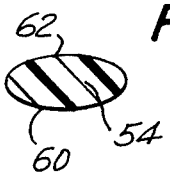
FIG. 4 is a cross-sectional view as taken along line 4—4 of FIG. 2.

As best seen in FIGS. 2–4, the representative arm 54, just like arm 52, has a pair of opposite side surfaces 60, 62 whose wider horizontal width dimension extends in a vertical plane which is generally parallel to the plane of the base 32. However, as considered in the longitudinal direction along the arm 54 away from the tip 50, the representative arm 54 gradually twists about its longitudinal axis of symmetry such that the side surfaces 60, 62 on the twisted grip portion 56 are now oriented in a generally horizontal plane. Side surface 60 on the twisted grip portion now faces generally upwardly, and side surface 62 now faces generally downwardly. The lower side surface 62 on the twisted grip portion 56 faces the open end 22 of the bag and is free of sharp edges so as to tend to resist undesirable creasing of the hand of a user. The twist in the intermediate bight portion 34 is formed by selecting the radius of curvature of the same to have a predetermined value. In a preferred embodiment, the distance between the bail end portions 36, 38 is about 5 inches; the length of the bail is about 13 inches; and the linear distance between upper base edge 48 and the lower side surface 62 is about 5 inches.

Each handle 30 is mounted on the front and rear panels of the bag by pulling its intermediate bight portion 56 through the aforementioned slits 26 formed on the fold line at the open end of the bag until the end portions 40, 42 of the base 32 abut against the non-slitted portions 70, 72 (see FIG. 1) of the fold line which bound the slits 26. In this position, the base 32 is sandwiched between the hem 24 and the upper marginal portions 28 of the front and rear panels; the bail end portions 36, 38 are also located underneath the hem 24; and the arms 52, 54 and the twisted grip portion 56 of the intermediate bight portion 34 are all located beyond the open end 22 of the bag.

Figure 5:
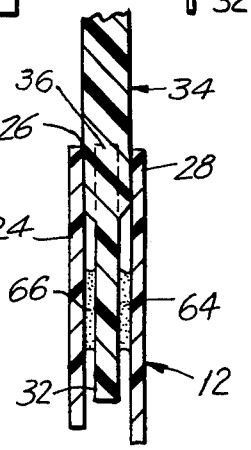
FIG. 5 is a sectional view as taken along line 5—5 of FIG. 1.

As best shown in FIG. 5, adhesive means, such as glue layers 64, 66, are used to fix the opposite sides of the base 32 to the marginal panel portion 28 and the hem 24, respectively. The glue layers not only fix the position of each handle to the bag, but also serve to close the slits 26.

As discussed above, the outer tapered surfaces 44, 46 of the bail end portions lie substantially close to the plane of the base 32. Inasmuch as the bail end portions 36, 38 are located between the hem 24 and the upper marginal portions 28 of the bag, the bail end portions impart an aesthetically pleasing, generally flat appearance to the bag in the regions overlying the bail end portions. In contrast to the prior art requirement of using staples to interconnect the bail end portions to the base, which caused these interconnection areas to be raised to an undesirable extent, and therefore imparted an unsightly lumpy appearance to these areas of the bag, the bail end portions of this invention are not raised to the extent which creates an unsightly, lumpy appearance.

Another feature of the invention resides in providing each base end region 40, 42 with a rounded upper edge 74, 76 which engages the non-slitted portions 70, 72. Each rounded upper edge tends to resist tearing of the non-slitted portions, particularly when heavy objects are carried in the bag.

The handles of the present invention can be used with many other types of shopping bags or similar hand-held containers without departing in any way from the spirit of this invention. Various modifications of the shopping bag illustrated in the drawings may also be made. For example, the hem 24 need not be circumferentially complete, but need only overlie the handle bases on the interior of the front and rear panels. The bag need not have pleated side panels. The cross-sectional configuration for the intermediate bight portion need not be a flattened oval as shown, but can be of any configuration. Other moldable plastic materials can be used to form the handle, but polyethylene is preferred for strength and economic reasons.

It will be understood that each of the elements described above, or two or more together, may also find a useful application in other types of constructions differing from the types described above.

While the invention has been illustrated and described as embodied in a pair of one-piece handles for a shopping bag, it is not intended to be limited to the details shown, since various modifications and structural changes may be made without departing in any way from the spirit of the present invention.

Without further analysis, the foregoing will so fully reveal the gist of the present invention, that others can, by applying current knowledge, readily adapt it for various applications without omitting features that, from the standpoint of prior art, fairly constitute essential characteristics of the generic or specific aspects of this invention and, therefore, such adaptations should, and are intended to, be comprehended within the meaning and range of equivalence of the following claims.

What is claimed as new and desired to be protected by Letters Patent is set forth in the appended claims.

1. A shopping bag, comprising:

a container having an upper openable end, a lower closed end, and side walls located between the ends and circumferentially bounding an interior space in which objects may be received, said side walls having upper marginal portions bounding the upper end, said container having an inner hem folded inwardly along a fold line and juxtaposed with the upper marginal portions, and openings formed along the fold line at opposite sides of the container;

a pair of one-piece handles mounted at the opposite sides of the container, each handle including a substantially planar elongated base located between a respective upper marginal portion at a respective side of the container and its respectively juxtaposed hem, each base having a first major adhesive contact surface facing and spaced from its respectively juxtaposed hem, and a second major adhesive contact surface facing and spaced from its respectively juxtaposed upper marginal portion, each handle having a predetermined thickness and being constituted of a moldable plastic material, each handle also including an elongated bail constituted of the same moldable plastic material as its respective base to form a one-piece molded plastic construction therewith, each bail having an end portion integrally and rigidly connected to both major surfaces of its respective base at a predetermined location thereon, an opposite end portion integrally and rigidly connected to both major surfaces of its respective base at another location thereon which is longitudinally spaced from the predetermined location, and an intermediate bight portion between the bail end portions and extending through a respective opening away from the upper end of the container, each bail end portion having a tapered end which decreases in thickness towards both major surfaces of its respective base from a larger thickness to a smaller thickness which corresponds to said predetermined thickness of its respective base, each bail end portion having smooth opposite outer surfaces facing the respectively juxtaposed upper marginal portion and the hem, each intermediate bight portion having a twisted hand-engaging portion which has a smooth lower surface facing the upper end of the container and which is free of sharp edges to facilitate gripping each handle and supporting the container; and an adhesive layer applied over each major contact surface of each handle, for securely adhering the handles at the opposite sides of the container, each adhesive layer being located in the spaces between the respective contact surface and the respectively juxtaposed upper marginal portion and the hem to thereby impart an esthetically pleasing, generally flat appearance to the shopping bag both at its exterior upper marginal portion and at its interior hem which overlie the bail end portions.

2. The shopping bag as defined in claim 1, wherein each base has end portions each having a rounded upper edge which engages an abutting portion of the container at the upper end thereof, each rounded edge being operative to resist tearing of the abutting container portions.

3. The shopping bag as defined in claim 1, wherein each bail has an oval cross-sectional shape.

4. The shopping bag as defined in claim 1, wherein each base and its respective bail are constituted of polyethylene.

* * * * *